US006471260B1

(12) United States Patent
Weinerman et al.

(10) Patent No.: US 6,471,260 B1
(45) Date of Patent: Oct. 29, 2002

(54) ROTARY LATCHES WITH ENHANCED SERVICE LONGEVITY

(75) Inventors: Lee S. Weinerman, Medina, OH (US); Arthur J. Kuminski, Parma, OH (US)

(73) Assignee: The Eastern Company, Cleveland, OH (US)

( * ) Notice: Subject to any disclaimer, the term of this patent is extended or adjusted under 35 U.S.C. 154(b) by 0 days.

(21) Appl. No.: 09/923,208

(22) Filed: Aug. 6, 2001

(51) Int. Cl.[7] ..... E05C 3/26

(52) U.S. Cl. ..... 292/216; 292/143; 292/342; 70/208; 70/472

(58) Field of Search ..... 292/143, 216, 292/342, 240, 34, DIG. 31, 48; 70/208, 472, 134, 486

(56) References Cited

U.S. PATENT DOCUMENTS

| | | | | | |
|---|---|---|---|---|---|
| 4,312,203 | A | | 1/1982 | Pastva, Jr. et al. | 70/472 |
| 4,320,642 | A | | 3/1982 | Pastva, Jr. | 70/472 |
| 4,703,961 | A | * | 11/1987 | Weinerman et al. | 292/216 |
| 4,896,906 | A | | 1/1990 | Weinerman et al. | 292/48 |
| 4,911,487 | A | * | 3/1990 | Rachocki | 292/216 |
| 4,917,412 | A | | 4/1990 | Swan et al. | 292/48 |
| 5,069,491 | A | * | 12/1991 | Weinerman et al. | 292/216 |
| 5,117,665 | A | | 6/1992 | Swan et al. | 70/264 |
| 5,299,844 | A | * | 4/1994 | Gleason | 292/240 |
| 5,439,260 | A | | 8/1995 | Weinerman et al. | 292/48 |
| 5,564,295 | A | | 10/1996 | Weinerman et al. | 70/208 |
| 5,586,458 | A | | 12/1996 | Weinerman et al. | 70/208 |
| 5,595,076 | A | | 1/1997 | Weinerman et al. | 70/208 |
| 5,611,224 | A | | 3/1997 | Weinerman et al. | 70/208 |
| 5,884,948 | A | | 3/1999 | Weinerman et al. | 292/216 |
| 5,941,104 | A | * | 8/1999 | Sadler | 292/216 |

* cited by examiner

*Primary Examiner*—Anthony Knight
*Assistant Examiner*—Mark Williams
(74) *Attorney, Agent, or Firm*—David A. Burge

(57) ABSTRACT

A rotary latch employs at least one rotary jaw that is releasably retained in its latched position by a rotary pawl. Housing side plates sandwich the rotary jaw, the rotary pawl and one or more torsion coil springs that bias the rotary jaw from an unlatched position toward a latched position, and the rotary pawl from a jaw-releasing position toward a jaw-retaining position. Improvements that enhance service longevity include the use of C-shaped hook formations defined by reaches of spring material that extend from torsion spring coils located alongside one or both of the rotary jaw and the rotary pawl to engage convexly shaped C-shaped formations of the rotary jaw and/or the rotary pawl that are located in the same plane as the torsion spring coils to provide long-lived connections between the torsion spring or springs and one or both of the rotary jaw and the rotary pawl.

40 Claims, 6 Drawing Sheets

ROTARY LATCHES WITH ENHANCED SERVICE LONGEVITY

BACKGROUND OF THE INVENTION

1. Field of the Invention

The present invention relates to improvements in rotary latches of the general type that employ at least one rotary jaw that is releasably retained in a latched position by a rotary pawl, wherein the rotary jaw and the rotary pawl extend principally within what can be referred to as a "primary plane" and pivot about separate parallel-extending axes that are substantially perpendicular to the primary plane, and wherein one or more torsion springs 1) extend principally within what can be referred to as a "secondary plane" located beside and extending parallel to the primary plane, 2) bias the rotary jaw away from its latched position toward its unlatched position, and 3) bias the rotary pawl away from its jaw-releasing position toward its jaw-retaining position—with improvements residing in the manner in which one or more end regions of the torsion springs are coupled to one or both of the rotary jaw and the rotary pawl by connections located principally within the secondary plane. More particularly, the present invention relates to improvements that enhance the service longevity of rotary latches and locks of the general type disclosed in U.S. Pat. Nos. 5,884,948, 5,611,224, 5,595,076, 5,586,458, 5,564,295, 5,439,260, 5,117,665, 5,069,491, 4,917,412, 4,896,906, 4,320,642 and 4,312,203 (referred to hereinafter as the "Rotary Latch Patents," the disclosures of which are incorporated herein by reference), by providing stress-diminished spring-to-rotary-jaw and spring-to-rotary-pawl connections that utilize C-shaped curve formations defined on end regions of the torsion spring or springs that open outwardly away from coils of the torsion spring or springs, wherein the C-shaped curve formations and peripheral portions of the spring coils are engaged by smoothly curved formations of the rotary jaw and/or the rotary pawl that extend from the primary plane into the secondary plane to establish the improved connections within the secondary plane in a manner that causes no twisting of the torsion springs when forces are transmitted between the torsion springs and the rotary jaw and/or rotary pawl to which the springs are coupled by the improved connections.

2. Prior Art

The Rotary Latch Patents referenced above disclose a variety of latch and lock products, each of which utilizes a rotary jaw that is biased by a torsion coil spring away from a latched position toward an unlatched position, and a rotary pawl that is biased by the same or a separate torsion coil spring away from a jaw-releasing position toward a jaw-retaining position. The rotary jaws and the rotary pawls of these units have engageable formations that cooperate to enable the rotary pawl to retain the rotary jaw in, and to release the rotary jaw from the latched position by pivoting the rotary pawl into and out of the jaw-retaining position.

Other features shared by rotary latch and lock units of general type disclosed in the Rotary Latch Patents include 1) the manner in which each of these units positions torsion coils of one or more torsion springs to extend in a secondary plane located beside and substantially paralleling a primary plane in which the rotary jaw and the rotary pawl extend, and 2) the manner in which connections are formed between end regions of the torsion springs and the rotary jaws and pawls—connections that utilize bent spring end formations that extend transversely out of the secondary plane and into the primary plane to hook across portions of the rotary jaws and pawls. To provide spring end formations that extend smartly across and that hook smartly onto portions of the rotary jaws and pawls, it has become quite customary to introduce relatively sharp bends into the spring end regions—essentially "right-angle bends" that are located at opposite ends of reaches of spring material that extend transversely across and hook onto the jaws and pawls.

While rotary latch and lock units of this type ordinarily offer lengthy service lives, it is important to work toward enhancing the service life longevity of these units by observing which components tend to fail the earliest, and by finding ways to improve the units to eliminate these early failures. Extensive testing has shown that, especially in the presence of excessive vibration, early failures can occur in the torsion springs of these units—failures that tend to be located within the vicinity of where a first right angle bend is used to connect a torsion spring coil to a reach of spring material that extends transversely out of the secondary plane into the primary plane to hook around rotary jaw or pawl portions located within the primary plane.

Most of these spring failures occur near right angle bends in torsion spring end regions that connect with rotary jaws, with a far fewer number of failures occurring near right angle bends in torsion spring end regions that connect with rotary bawls. The fact that more jaw-spring failures have been noted than pawl-spring failures makes sense inasmuch as the rotary jaws pivot through a much wider range of angular movement than do the rotary pawls (which puts more stress on torsion spring portions that connect to the rotary jaw than is experienced by torsion spring that connect with the rotary pawl), and inasmuch as the rotary jaws and the spring portions connected thereto often are subjected to sudden impact forces that come as the result of slamming a strike formation directly into engagement with a rotary jaw to pivot the jaw quickly from its unlatched position to its latched position (whereas rotary pawls and spring portions connected thereto are seldom subjected to sudden and severe impact forces of this type).

If one studies the region of the first right angle bend (where a torsion coil is connected by a right angle bend to a reach of spring material that extends transversely out of the secondary plane across the primary plane to hook around portions of a rotary jaw or pawl), what becomes apparent is that, in the vicinity of this bend, twisting forces are applied to the spring as the transversely extending reach is utilized to transmit forces between the torsion coil and the rotary jaw or pawl. This twisting of the spring in the vicinity of the first right angle bend causes greater stress to occur in the vicinity of the first right angle bend than occurs elsewhere in the spring—and the result, quite naturally, is that the spring tends to break in the vicinity of the first right angle bend after extensive cycles of use or in the presence of severe vibration.

Still another factor that may contribute to early spring breakage within the vicinity of right-angle bends has to do with stresses that may be introduced into a spring in the vicinities of its right angle bends when the spring is formed. The tighter the bend that is formed in a piece of spring wire, the greater is the tendency to introduce unwanted stresses in the vicinity of the bend.

It is well established that even small but cost effective improvements in rotary latch and lock units of the type disclosed in the referenced Rotary Latch Patents tend to gain quick acceptance in industry. There are millions of rotary latch and lock units of this general type presently in service, and the replacement of broken, damaged or disabled units with units that offer enhanced service longevity is a serious ongoing undertaking. In this vein, the improvement features offered by patents such as U.S. Pat. No. 5,884,948, for example, have gained rapid acceptance in industry by providing enhanced service longevity in rotary latch units of relatively low cost.

An important consideration to be taken into account when improvements are provided in rotary latch and lock units of the type disclosed in the referenced Rotary Latch Patents is the fact that the improved units need to offer interchangeability with units that are already in service—so that, when improved units are installed to replace broken, damaged or disabled units, the replacement units will offer size and configuration interchangeability with the units they replace, otherwise the installation of the replacement units would be rendered unduly difficult, and other components that are located near the replaced latch units might need to be repositioned or restructured.

Still another important consideration is the normally higher cost of replacement units that offer enhanced service longevity. Whereas present-day units are formed utilizing simple wire-wound springs and stamped jaw, pawl and side plate components, life-enhanced units may employ more costly components. The improvements they offer in service longevity need to justify any added costs that result.

A further consideration to take into account if present-day rotary latch products are to be provided with improvements is a need that sometimes arises, for example in automotive applications, for rotary jaws to be provided with boot-like protective rubber or elastomeric coatings that cover striker-engaging portions of the jaws to help silence latch operation. The jaws of most present-day rotary latches carry no formations that are well suited to assist in holding boot-like protective rubber or elastomeric coatings in place; hence, when rubber or elastomeric coatings are applied to the jaws of present-day latches, it is often found that they slip off (in much the same way that a pair of low-cut overshoes can slip off quite easily from shoes on which they have been installed).

SUMMARY OF THE INVENTION

The present invention provides a number of improvements relating to rotary latches of the general type disclosed in the referenced Rotary Latch Patents, including a way in which non-right-angled hook-like connections evincing significantly improved service life longevity can be provided between a rotary jaw (or a rotary pawl) and a torsion spring end region that connects therewith. Since breakage of jaw connected springs is what most often disables a rotary latch or lock, improving the spring-to-jaw connection is a major thrust of the present invention; and, such other improvements as may be provided to accompany this significant improvement are considered optional but well worth considering when new rotary latch and lock products are manufactured.

In one form of the present invention, a rotary latch includes a rotary jaw and a rotary pawl that are mounted for limited pivotal movement about separate substantially parallel-extending axes, wherein the rotary jaw is pivotal between a latched position and an unlatched position, and wherein the rotary pawl is pivotal between a jaw-retaining position wherein a jaw-engageable portion of the rotary pawl is engageable with a pawl-engageable portion of the rotary jaw to retain the rotary jaw in the latched position, and a jaw-releasing position wherein the jaw-engageable portion of the rotary pawl disengages the pawl-engageable portion of the rotary jaw and thereby permits the rotary jaw to pivot from the latched position to the unlatched position. The rotary jaw also includes a strike-engageable portion adapted to latchingly engage a strike formation when the rotary jaw is in the latched position, and to release the strike formation for movement toward and away from the rotary jaw when the rotary jaw is in the unlatched position. The jaw-engageable portion, the pawl-engageable portion and the strike-engageable portion all extend within a primary plane that is substantially perpendicular to the parallel-extending axes about which the rotary jaw and the rotary pawl pivot.

The rotary latch also includes biasing means for biasing the rotary jaw away from the latched position toward the unlatched position, and for biasing the rotary pawl away from the jaw-releasing position toward the jaw-retaining position. The biasing means includes at least one torsion spring having at least one torsion spring coil that surrounds at least one of the parallel-extending axes, and having and at least one reach of spring material that extends from a peripheral portion of the spring coil to define a C-shaped hook formation. The torsion spring coil, the reach of spring material and the C-shaped hook formation all extend within a secondary plane located beside and substantially paralleling the primary plane.

The rotary latch also includes means for engaging the peripheral portion of the torsion spring coil and the C-shaped hook formation to establish a connection between the torsion spring and a selected one of the rotary jaw and the rotary pawl, including a first connection portion of the selected one of the rotary jaw and the rotary pawl that extends transversely from the primary plane into the secondary plane to define within the secondary plane a first surface that is positioned to extend along a length of the peripheral portion adjacent the reach of spring material that defines the C-shaped hook formation, and a second surface that joins smoothly with the first surface to define a convexly curved C-shaped formation that substantially matches the shape of and is adapted to be received within the C-shaped hook formation. By this arrangement, a connection residing in the secondary plane is established between the torsion spring and the selected one of the rotary jaw and the rotary pawl—a connection that does not cause twisting of the torsion spring when forces are transmitted between the spring and the selected one of the rotary jaw and the rotary pawl.

In preferred practice, the first surface is, in fact, a curved surface that has substantially the same curvature as the peripheral portion of the torsion coil spring; the second curved surface joins smoothly with the first curved surface; and the first curved surface is positioned to engage a length of the peripheral portion adjacent the reach of spring material that defines the C-shaped hook formation—an arrangement that further assists in providing a stress-minimized, breakage resistant connection.

Other optional features can be included in rotary latch and lock units that embody the invention. If the first connection portion is provided on the rotary jaw, the first connection portion can include portions that enlarge the cross-sectional area of the second U-shaped notch defined by the rotary jaw—so as to increase the area of the rotary jaw that engages the strike formation when the rotary jaw is latched. Increasing this area of engagement (i.e., increasing the effective thickness of the rotary jaw in the region that engages the strike formation) reduces wear on the rotary jaw caused by its engagement with the strike formation, and reduces wear on the strike formation caused by its engagement with the rotary jaw inasmuch as a more even distribution of load is achieved when larger surfaces areas of the strike formation and the rotary jaw engage each other.

An important advantage that results when the improvement features of the present invention are applied to the rotary jaw is that spring breakage in the area where the torsion spring connects with the rotary jaw is significantly diminished, and tends to occur only after a much longer service life, especially in the presence of excessive vibration. Tests have documented a considerable improvement in service longevity.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Referring to FIGS. 1–4, a "prior art" or known type of rotary latch not embodying features of the present invention is indicated generally by the numeral 100.

Figure 4:
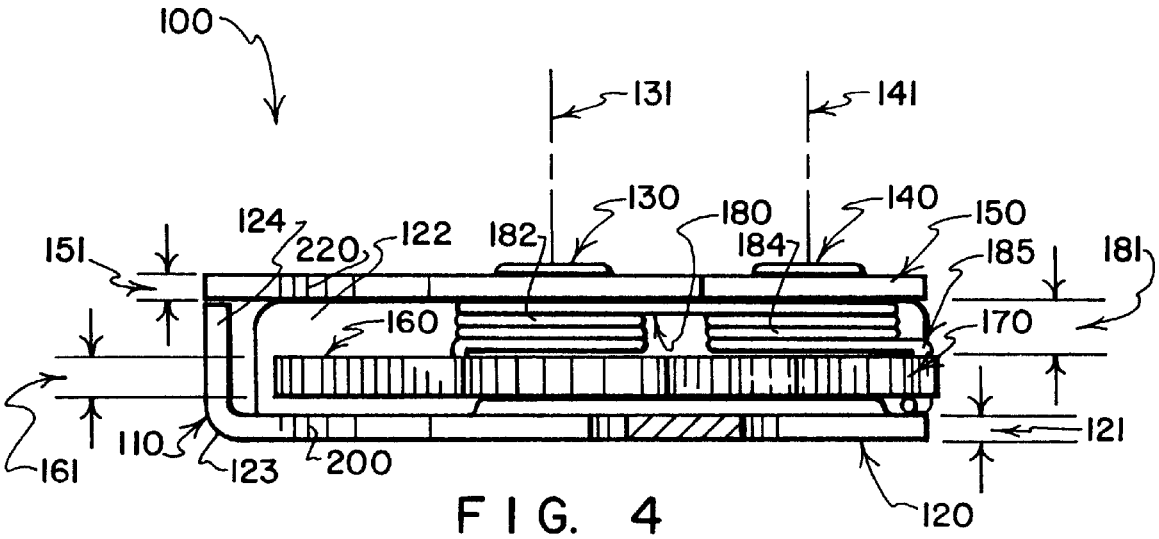
FIG. 4 PRIOR ART
FIG. 4 is a bottom plan view of the rotary latch of FIG. 1 (including both housing side plates), with the rotary jaw and the rotary pawl positioned as depicted in FIG. 1.

The rotary latch 100 has a housing 110 that includes a generally rectangular first side plate 120 which is connected by bends 121, 123 to a relatively long transversely extending flange 122 and a relatively short transversely extending flange 124 that extend along relatively lengthy and relatively short sides, respectively, of the generally rectangular first side plate 110. The housing 110 also includes first and second generally cylindrical members 130, 140 that extend along substantially parallel-extending axes 131, 141, respectively. Referring to FIG. 4, the housing 110 also includes a generally rectangular second side plate 150. Each of the generally cylindrical members 130, 140 has one end region rigidly connected to the first housing side plate 120, and an opposite end region rigidly connected to the second housing side plate 150.

Sandwiched between the housing side plates 120, 150 are a rotary jaw 160, a rotary pawl 170, and a torsion coil spring 180. Those who are skilled in the art will readily appreciate that a pair of torsion coil springs, each operating on a separate one of the rotary jaw 160 and the rotary pawl 170, can replace the double-coiled torsion coil spring 180 as rotary latches employing such dual springs have been marketed from time to time.

Figure 1:
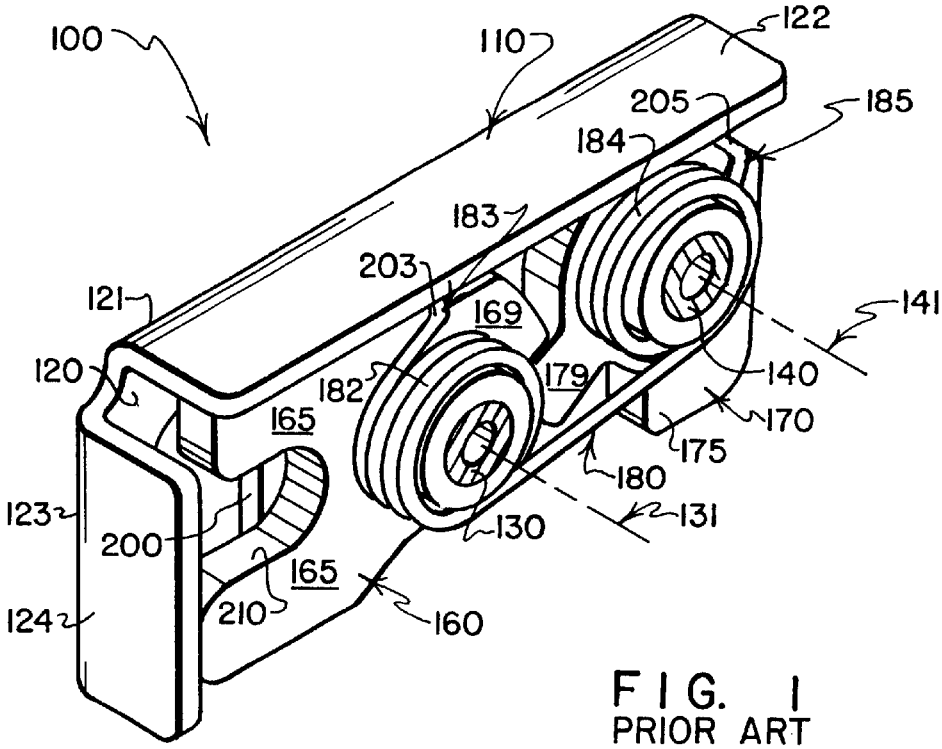
FIG. 1 PRIOR ART
FIG. 1 is a perspective view showing a prior art or known form of rotary latch that does not embody features of the present invention, with portions of the latch including one of its two housing side plates removed, with portions of the latch including the two generally cylindrical members that support a torsion coil spring, a rotary jaw and a rotary pawl broken away and shown in cross-section, with the rotary jaw shown in its latched position, and with the rotary pawl shown in its jaw-retaining position.
Figure 2:
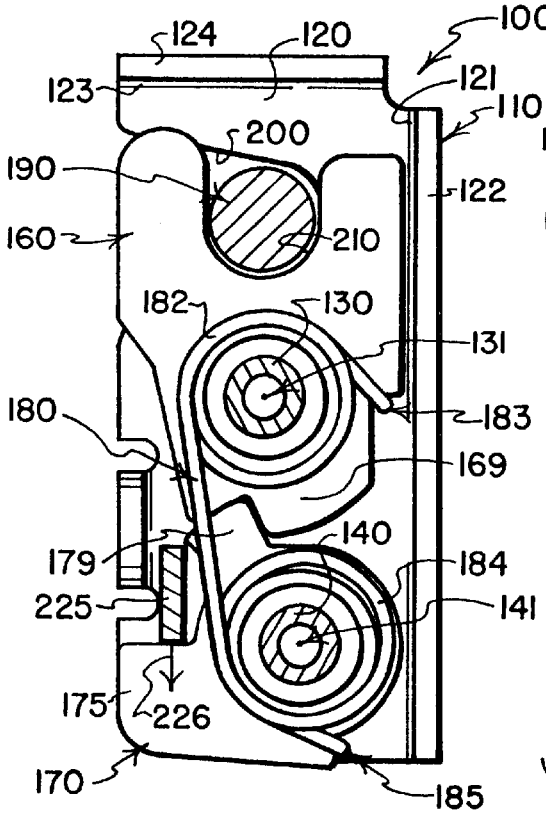
FIG. 2 PRIOR ART
FIG. 2 is a side elevational view of the latch components of FIG. 1, with the rotary jaw and the rotary pawl positioned as depicted in FIG. 1, and with a strike formation shown latchingly retained within U-shaped notches of the housing and the rotary jaw.
Figure 3:
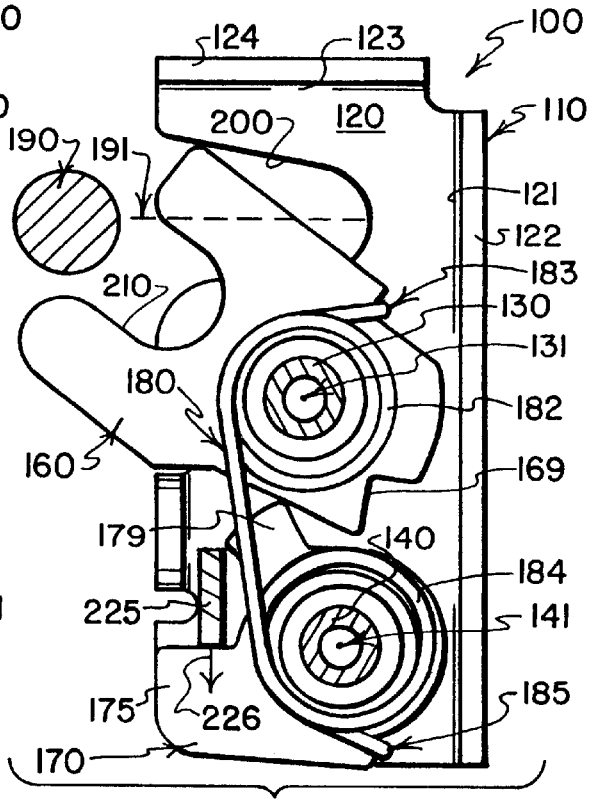
FIG. 3 PRIOR ART
FIG. 3 is a side elevational view similar to FIG. 2 but with the rotary jaw pivoted to its unlatched position, with the rotary pawl in a jaw-releasing position, and with the strike formation moved out of latched engagement along a path of travel indicated by a broken line.

The rotary jaw 160 is mounted on the first generally cylindrical member 130 for pivotal movement about the first axis 131 between a latched position depicted in FIGS. 1, 2 and 4, and an unlatched position depicted in FIG. 3. The rotary pawl 170 is mounted on the second generally cylindrical member 140 for pivotal movement about the second axis 141 between a jaw-retaining position depicted in FIGS. 1, 2 and 4, and jaw-releasing positions, one of which is depicted in FIG. 3. The torsion coil spring 180 has coils 182 that bias the rotary jaw 160 away from the latched position toward the unlatched position, and has coils 184 that bias the rotary pawl 170 away from jaw-releasing positions toward the jaw-retaining position.

Referring to FIG. 3, when the rotary jaw 160 is in the unlatched position, a generally cylindrical strike formation 190 can move along a path of travel 191 into and out of a first U-shaped notch 200 which is defined by the first housing side plate 120, as is best seen. As the strike formation 190 moves into the first U-shaped notch 200, it is received within a second U-shaped notch 210 which is defined by a strike-engageable portion 165 of the rotary jaw 160; and, as the strike formation 190 continues to move into the first and second U-shaped notches 200, 210, the rotary jaw 160 is caused to be pivoted away from the unlatched position depicted in FIG. 3 to the latched position depicted in FIG. 2. As the rotary jaw 160 reaches the latched position depicted in FIG. 2, the biasing action of the torsion coil spring 180 causes the rotary pawl 170 to pivot into its jaw-retaining position (depicted in FIG. 2) wherein a jaw-engageable portion 179 of the pawl 170 engages a pawl-engageable portion of 169 of the rotary jaw 160 to thereby latchingly retain the rotary jaw 160 in its latched position. When the rotary jaw 160 is held in its latched position by the rotary pawl 170, the strike formation 190 is latchingly retained in the U-shaped notches 200, 210 and the latch 100 is said to be "latched."

When it is desired to "unlatch" or "release" the latch 100 from engagement with the strike formation 190, this is effected by pivoting the rotary pawl 170 out of its jaw-retaining position to a jaw-releasing position to enable the rotary jaw 160 to pivot out of its latched position to its unlatched position under the influence of the biasing action of the torsion coil spring 180. To pivot the rotary pawl 170 out of its jaw-retaining position, any of a wide variety of types of operating arms can be used to engage the pawl 170 and cause it to pivot about the second axis 141. In FIGS. 2 and 3, a portion of one such operating arm 225 is depicted in cross-section engaging an operating portion 175 of the rotary pawl 170. Movement of the operating arm 225 in a direction indicated by an arrow 226 (see FIGS. 2 and 3) will pivot the pawl 170 out of its jaw-retaining position to permit the rotary jaw 160 to pivot from its latched position to its unlatched position under the influence of the biasing action of the torsion coil spring 180.

Suitable configurations of a variety of operating arms for use with rotary latches (such as the rotary latch 100) are disclosed in the referenced Rotary Latch Patents. Also provided in the referenced Rotary Latch Patents are more detailed discussions of the manner in which such rotary latch assemblies may be utilized in a variety of applications—including applications that add key operated lock elements and hand-operated actuators to provide systems that can latch and/or lock closures in their closed positions.

Returning to a description of the prior art rotary latch 100, the second housing side plate 150 can be provided with a third U-shaped notch 220 (see FIG. 4) that is configured substantially the same as, and that is aligned with the first U-shaped notch 200 provided in the first housing side plate 120. Alignment of the first and third U-shaped notches 200, 220 enables the notches 200, 220 to concurrently receive and guide the movement of the strike formation 190 along the path of travel 191 as the strike formation 190 moves into and out of the second U-shaped notch 210 as the rotary jaw 160 moves into and out of its latched positions.

Referring to FIG. 4, the relative arrangement of the various components of the rotary latch 100 merits some mention. The generally rectangular housing side plates 120, 150 have portions that are of substantially uniform thickness that extend in spaced, substantially parallel planes that are indicated generally by the numerals 121, 151. The rotary jaw 160 and the rotary pawl 170 are substantially flat and of substantially uniform thickness, and are arranged so as to align and to extend in a common plane designated generally by the numeral 161 and referred to hereinafter as a "primary plane." The torsion coil spring 180 has coils 182 that extend about the first and second axes 131, 141; and, as can be seen in FIG. 4, the coils 182, 184 extend in a common plane designated generally by the numeral 181 and referred to hereinafter as a "secondary plane."

While, in geometry, the term "plane" is used to indicate an imaginary flat surface having no thickness, some liberty is taken in this document in utilizing the term "plane" to refer to a basically flat region of space that has a known thickness. For example, the planes 121, 151 refer to flat regions of space occupied by portions of the housing plates 120, 150 and having a thickness that equals the average thickness of flat portions of the first and second housing plates 120, 150 that are depicted in FIG. 4 and designated by the dimensions 121, 151; the primary plane 161 refers to a flat region of space occupied by portions of the rotary jaw and pawl 160, 170 depicted in FIG. 4 and having a thickness that equals the average thickness of the flat portions of the rotary jaw and pawl 160, 170, as depicted in FIG. 4 and designated by the dimension 161; and, the thickness of the secondary plane 181 equals the widths of the coils 182, 184 of the torsion spring 180, as depicted in FIG. 4 and designated by the dimension 181. In the manner just explained, the term "plane" is used consistently throughout this document.

Referring to FIG. 4, it will be seen that the first, second, primary and secondary planes 121, 151, 161, 181 extend substantially parallel to each other; that the primary and secondary planes 161, 181 extend in side-by-side relationship adjacent each other; and that the first and second axes 131, 141 extend perpendicular to the first, second, primary and secondary planes 121, 151, 161, 181.

Figure 5:
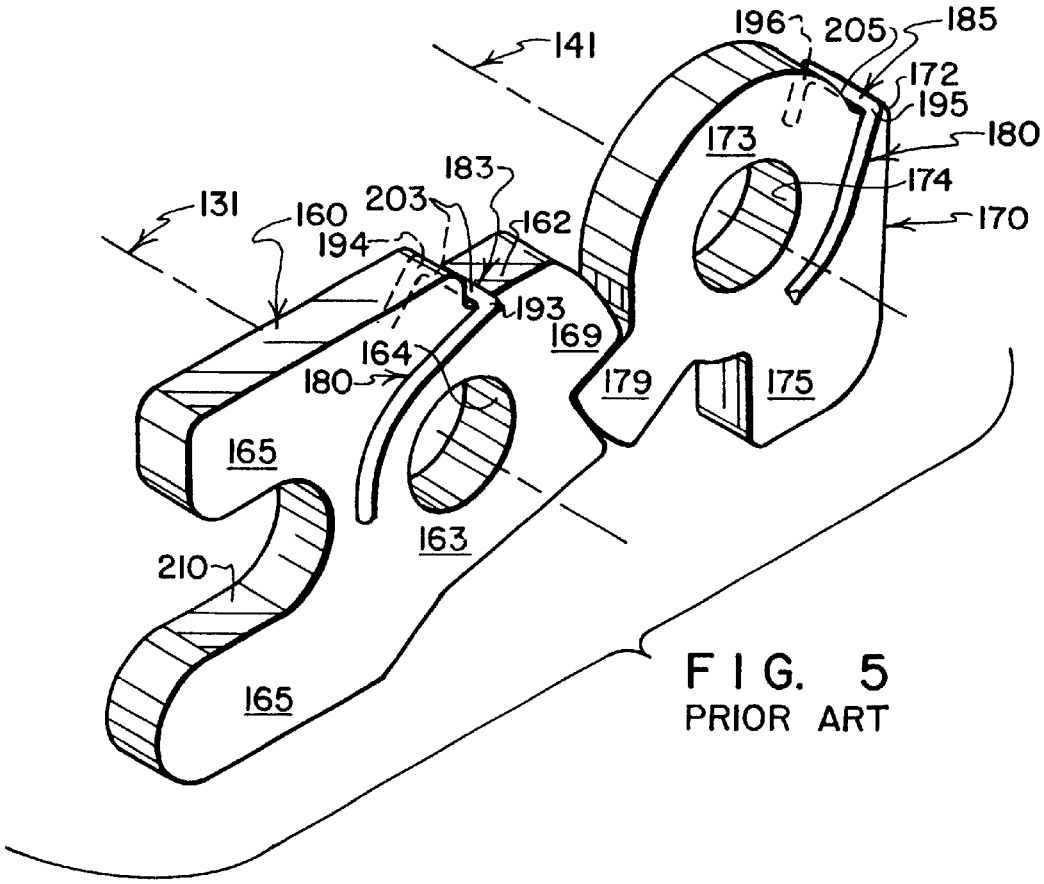
FIG. 5 PRIOR ART
FIG. 5 is an enlarged perspective view of the rotary jaw, the rotary pawl, and portions of the torsion coil spring of the latch of FIG. 1, with the rotary jaw in the latched position and the rotary pawl in the jaw-retaining position.
Figure 6:
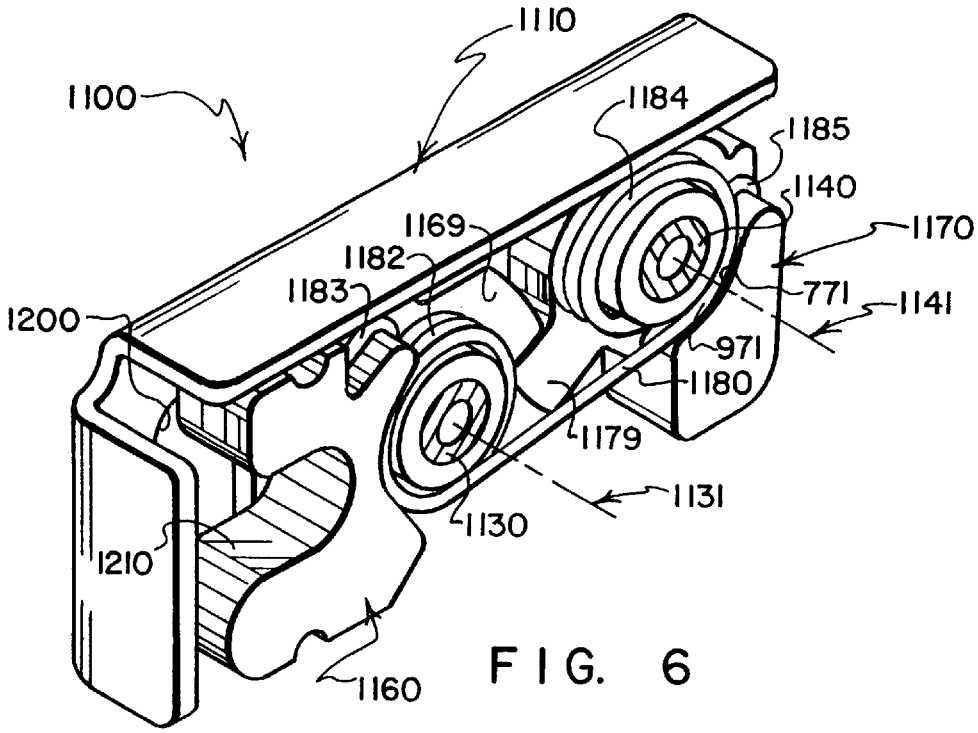
FIG. 6 is a perspective view of one embodiment of a rotary latch that includes features of the present invention, with portions of the latch including one of its two housing side plates removed, with portions of the latch including the two generally cylindrical members that support a torsion coil spring, a rotary jaw and a rotary pawl broken away and shown in cross-section, with the rotary jaw shown in its latched position, and with the rotary pawl shown in its jaw-retaining position.

Referring to FIG. 5, the rotary jaw 160 and the rotary pawl 170 have mounting portions 163, 173 that have mounting holes 164, 174 formed therethrough to receive generally cylindrical portions of the generally cylindrical members 130, 140 to mount the rotary jaw 160 and the rotary pawl 170 for pivotal movement about the first and second axes 131, 141. The mounting portion 163 of the rotary jaw 160 and the mounting portion 173 of the rotary pawl 170 extend in a common plane with strike-engageable portion 165 and the pawl-engageable portion 169 of the rotary jaw 160 and with the jaw-engageable portion 179 of the rotary pawl 170—namely within the "primary plane" 161 that is depicted in FIG. 4.

While major portions of the torsion coil spring 180 extend within the "secondary plane" 181 (see FIG. 4), end regions 183, 185 (see FIGS. 1 and 5) of the torsion coil spring 180 provide boxy hook-shaped formations (that include right-angle bends 193, 194, 195, 196 and transversely extending reaches 202, 205, as best seen in FIG. 5) that extend transversely out of the secondary plane 181 and into the primary plane 161 to engage and wrap about portions of the rotary jaw 160 and the rotary pawl 170 to establish driving connections between the torsion coil spring 180 and the rotary jaw and pawl 160, 170. These driving connections enable the spring 180 to transmit forces to the rotary jaw 160 and to the rotary pawl 170 to bias the rotary jaw 160 away from its latched position toward its unlatched position, and to bias the rotary pawl 170 away from jaw-releasing positions toward the jaw-retaining position. Referring to FIG. 5, a recessed region of the rotary jaw 160 that is engaged by the transversely extending portion 203 of the torsion spring end region 183 is indicated by the numeral 162; and, a recessed region of the rotary pawl 170 that is engaged by the transversely extending portion 205 of the torsion spring end region 185 is indicated by the numeral 172.

When forces are transmitted between the spring 180 and one or the other of the rotary jaw and pawl 160, 170 (which transmission takes place by virtue of the engagements of the transversely extending reaches 203, 205 of the spring end regions 183, 185 with the recessed region 162 of the rotary jaw 160 and with the recessed region 172 of the rotary pawl 170, respectively), twisting of the spring 180 occurs within the vicinities of the first right angle bends 193, 195 which can significantly increase the magnitude of any stresses that may already have been introduced into the spring 180 when the right angle bends 193, 195 were formed. Especially in the presence of excessive vibration, this unwanted twisting and undesirable stressing of the spring 180 in the vicinities of the right angle bends 193, 195 is believed to explain why the spring 180 tends to break most often in the vicinity of one or the other of the right angle bends 193, 195.

Referring to FIGS. 6–9, an improved form of rotary latch is indicated generally by the numeral 1100. Inasmuch as the latch 1100 has components and features that find correspondence in the components and features of the latch 100, corresponding numerals differing by a magnitude of one thousand are utilized in FIGS. 6–10 to designate components and features of the latch 100 that correspond to components and features of the latch 100 as depicted in FIGS. 1–5. The use of corresponding numerals to designate corresponding components and features of the latches 100, 1100 makes it unnecessary to repeat (in disclosing components and features of the latch 1100) much of the description that is presented of components and features of the latch 100.

Thus it will be understood that the first and second housing side plates 1120, 1150 of the latch 1100 correspond to the first and second housing side plates 120, 150 of the latch 100—indeed, the housing side plates 1120, 1150 are identical in every respect to the housing side plates 120, 150. Likewise the rotary jaw 1160, the rotary pawl 1170 and the torsion coil spring 1180 of the latch 1100 correspond to the rotary jaw 160, the rotary pawl 170 and the torsion coil spring 180 of the latch 100—and this "correspondence" holds true even though the components 1160, 1170, 1180 of the latch 1100 have configuration differences that distinguish the components 1160, 1170, 1180 from their corresponding counterparts 160, 170, 180, as will be explained.

A comparison of FIGS. 6–9 with FIGS. 1–4 renders it quite apparent that the latch 1100 has its components arranged in substantially the same way as the latch 100. The fact that the housings 1110, 110 of the latches 1000, 100 are formed by identical housing side plates 1120, 120 and 1150, 150 that are connected by identical generally cylindrical members 1130, 130 and 1140, 140 that extend along identically arranged sets of spaced, parallel-extending axes 1131, 131 and 1141, 141, respectively, renders it unnecessary to repeat much of the description that has already been presented in conjunction with the latch 100 (in order for the reader to quickly grasp the basics of construction and operation of the latch 1100).

Figure 9:
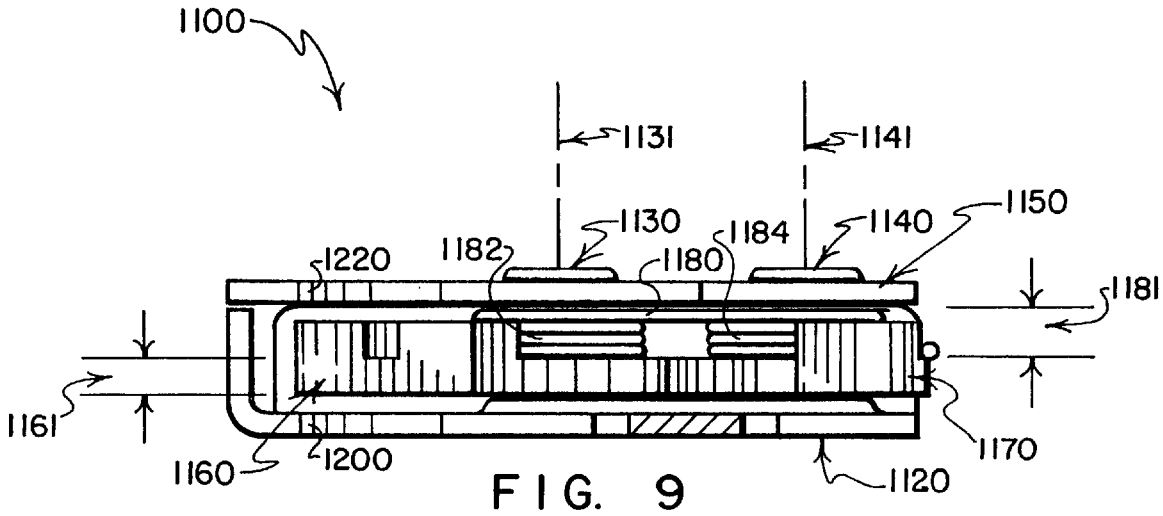
FIG. 9 is a bottom plan view of the rotary latch of FIG. 6 (including both housing side plates), with the rotary jaw and the rotary pawl positioned as depicted in FIG. 6.
Figure 10:
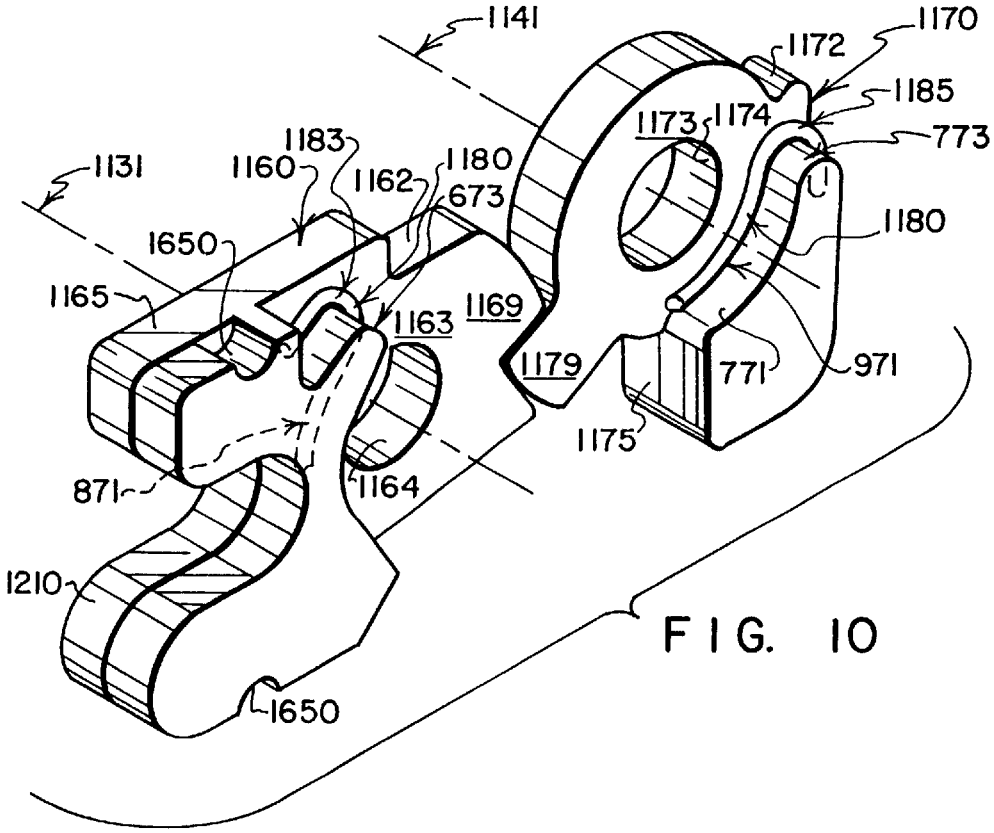
FIG. 10 is an enlarged perspective view of the rotary jaw, the rotary pawl, and portions of the torsion coil spring of the latch of FIG. 6, with the rotary jaw in the latched position and the rotary pawl in the jaw-retaining position.

Referring to FIG. 9, the latch 1100 has a "primary plane" 1161 within which a majority of the "meat" of the rotary jaw 1160 and the rotary pawl 1170 extend, including much of the material that defines the strike-engageable portion 1165, and all of the material that defines the mounting portion 1163 and the pawl-engageable portion 1169 of the rotary jaw, and all of the material that defines the mounting portion 1173 of the rotary pawl 1170, as depicted in FIG. 10.

As with the latch 100, the latch 1100 has a first U-shaped notch 1200 defined by the first housing side plate 1120 that aligns with a third U-shaped notch 1220 defined by the second housing side plate 1150; and, a third U-shaped notch 1210 defined by a rotary jaw 1160 cooperates with the first and third U-shaped notches 1200, 1220 as a strike formation 1190 moves along a path of travel 1191 (see FIG. 8) into seated engagement with the U-shaped notches 1200, 1210, 1220. When the rotary jaw 1160 is pivoted by movement of the strike formation 1190 along the travel path 1191 to its latched position (see FIG. 7), the rotary pawl 1170 is pivoted by the torsion spring 1180 to its jaw-retaining position (see FIG. 7) wherein it latchingly retains the rotary jaw 1160 in its latched position until the rotary jaw is reversely rotated, in opposition to the action of the spring 1180, to permit the rotary jaw 1160 to rotate under the influence of the spring 1180 to its unlatched position (see FIG. 8) whereupon the strike formation 1190 is free to move out of the U-shaped notches 1200, 1210, 1220.

What distinguishes the latch 1100 from the latch 1100 is addition of supplemental material to the rotary jaw and to the rotary pawl to provide a rotary jaw and a rotary pawl that have specially configured spring-engaging formations that minimize the stressing of the torsion spring; and, extensions of the lengths of the end regions of the torsion coil spring to form gently rounded C-shaped hooks 1183, 1185 that open outwardly within the same plane as is occupied by the torsion coils of the spring can be used to provide no-twist driving connections with the specially configured spring-engaging formations that have been added to the rotary jaw and to the rotary pawl. As also will be noted in FIG. 10, while recessed regions 1162, 1172 are provided on the rotary jaw and pawl 1160, 1170 (that correspond to the recessed regions 162, 172 that are engaged by transversely extending portions 203, 205 of the spring end regions 183, 185 in the latch 100), these regions 1162, 1172 are not utilized by the spring end regions 1183, 1185 and can, in fact, be eliminated if desired from the design of the rotary jaw and pawl 1160, 1170.

Actually, an important feature of the invention resides in the fact that one can make selective use of its features so as to provide latch improvements to whatever degree is desired—taking into account the fact that, as changes are made and improvements are added to a particular latch design, the addition of relatively few improvements often is less costly than the addition of a larger number of improvements. Since torsion spring breakage has been noted to take place more often in the vicinity of spring-to-jaw connections than in the vicinity of spring-to-pawl connections, the addition of specially configured formations to jaws that enable C-shaped hook formations to be utilized at spring-to-jaw connections clearly constitutes a more cost effective improvement to make than is the addition of specially configured formations to pawls that enable C-shaped hook formations to be utilized at spring-to-to pawl connections—and, either or both of these types of improvements can in fact be made selectively.

Moreover, inasmuch as it also has been noted that latch and strike wear can be significantly diminished if the specially configured formations added to the jaw are structured in a way that effectively increases the area of contact of the jaw and the strike so as to better distribute the forces that are transmitted between the jaw and the strike, it is even more cost effective (in terms of providing an increase in latch and strike service longevity, and in terms of minimizing "down time" that can result when time must be taken to replace broken or worn out latches and strikes) if the improvements of the present invention are directed primarily to the spring-to-jaw connection rather than to the spring-to-pawl connection.

Nonetheless, when new rotary latches are being tooled, or when tooling is being replaced, adding the spring-to-pawl connection improvements of the present invention may prove to be worth adding so that as other latch improvements are incorporated during years to come, latch failures will be minimized at spring-to-pawl connections as well as at spring-to-jaw connections.

Thus, while it will be understood by those who are skilled in the art that the latch 1100 is shown as incorporating both spring-to-jaw and spring-to-pawl improvement features, it may be desirable to selectively implement the improvement features of the present invention as by initially adding only the very cost-effective spring-to-jaw connection improvements to new products so as to effect very worthwhile improvements at a minimum of cost.

Figure 11:
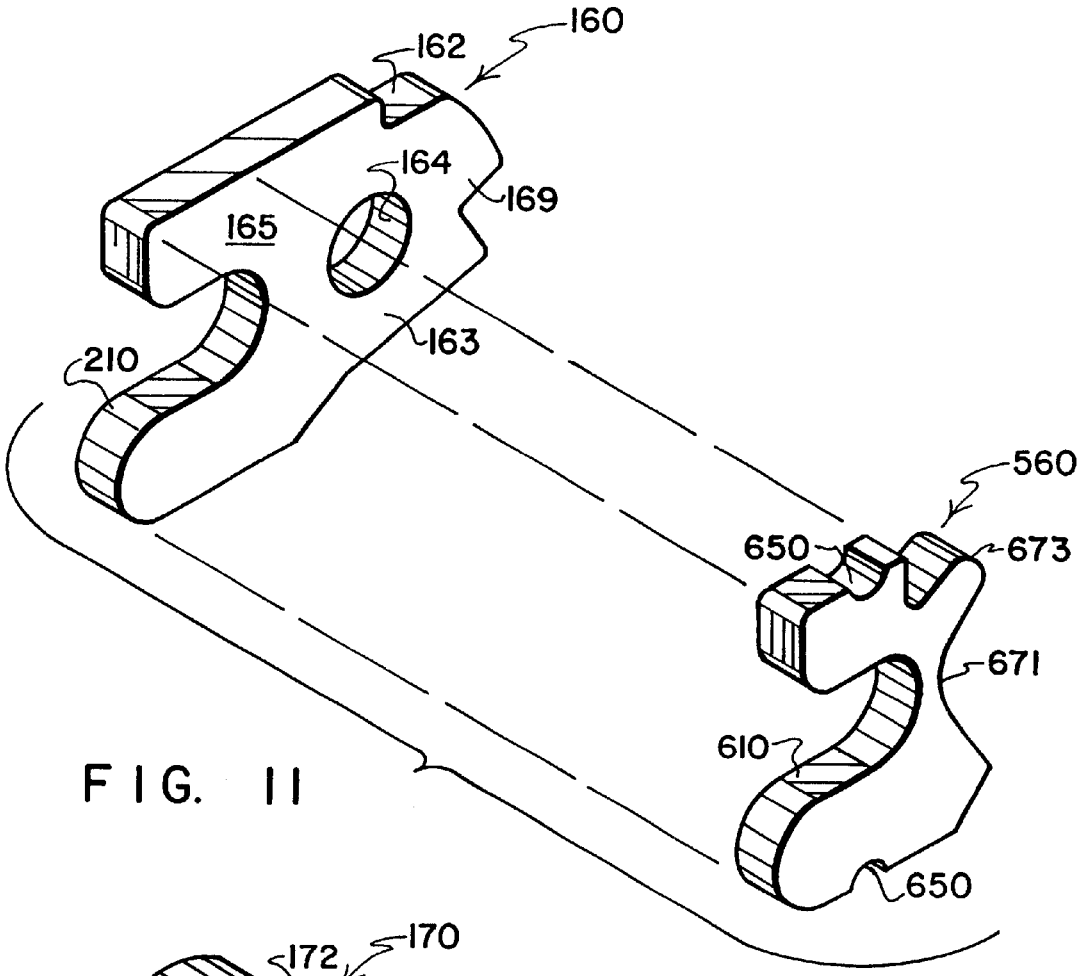
FIG. 11 is an exploded perspective view of two components that may be utilized to form the rotary jaw depicted in FIG. 10.
Figure 12:
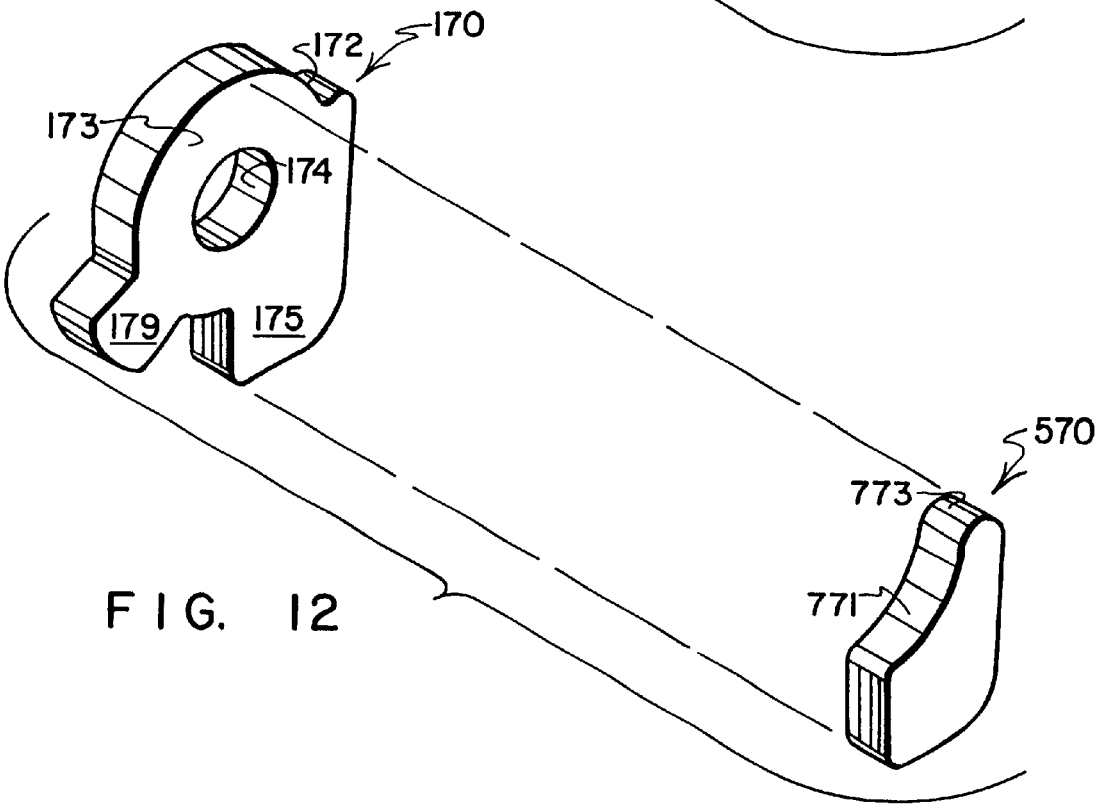
FIG. 12 is an exploded perspective view of two components that may be utilized to form the rotary pawl depicted in FIG. 10.

While FIG. 10 illustrates the new rotary jaw 1160 and the new rotary pawl 1170 configurations that are utilized if both spring-to-jaw and spring-to-pawl connection improvements are to be incorporated in providing an improved latch 1100, FIGS. 11 and 12 are perhaps easier to understand if one wants to see precisely what in the way of supplemental material is to be added to a rotary jaw and a rotary pawl of the traditional type (i.e., the type used in the latch 100) in order to provide the improvements of the latch 1100.

Referring to FIG. 11, a rotary jaw of the traditional type is designated by the numeral 160 inasmuch as the depicted jaw is identical to the rotary jaw 160 used in the latch 100. Also depicted in FIG. 10 is a supplementary jaw element 560 that can be rigidly attached to the rotary jaw 160 (as by fusion welding, spot of projection welding, mig or tig welding, bonding, riveting or other conventional joining techniques, or by new joining techniques that may be developed during future years) to provide an improved rotary jaw 1160 having the configuration that is depicted in FIG. 10. Alternatively, of course, a rotary jaw 1610 having the configuration depicted in FIG. 10 can be formed as a one-piece element that requires no welding, bonding or other juncture of component parts, as by utilizing techniques that are employed in forming metal components by the pressing and treating of metal powder, or by other existing or future-developed techniques.

Figure 7:
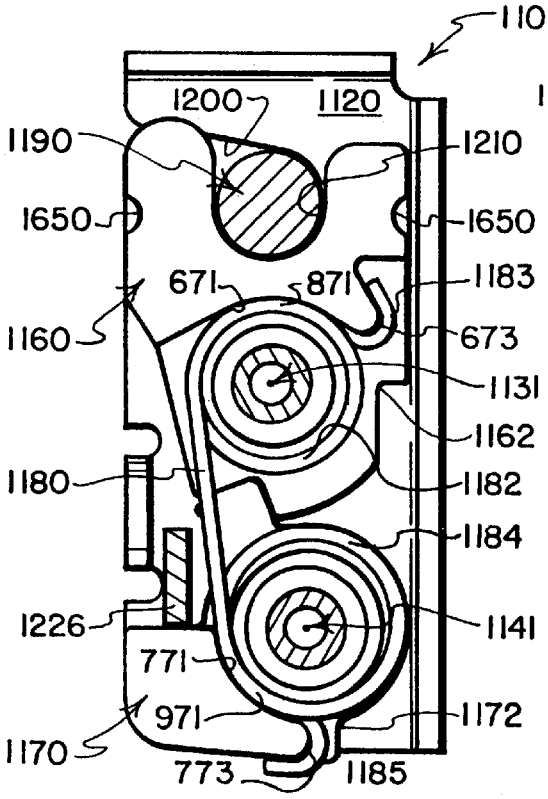
FIG. 7 is a side elevational view of the latch components of FIG. 6, with the rotary jaw and the rotary pawl positioned as depicted in FIG. 6, and with a strike formation shown latchingly retained within U-shaped notches of the housing and the rotary jaw.

Referring to FIG. 11, it will be seen that the U-shaped notch 210 of the rotary jaw 160 is duplicated in the supplementary jaw element 560 by a U-shaped notch 610 that can be positioned in side-by-side alignment with the notch 210 to increase the effective surface area 1210 of the resulting jaw 1160 (FIG. 10) that is presented to a strike formation (such as the strike formation 1190 depicted in engagement with the jaw 1160 in FIG. 7).

Figure 15:
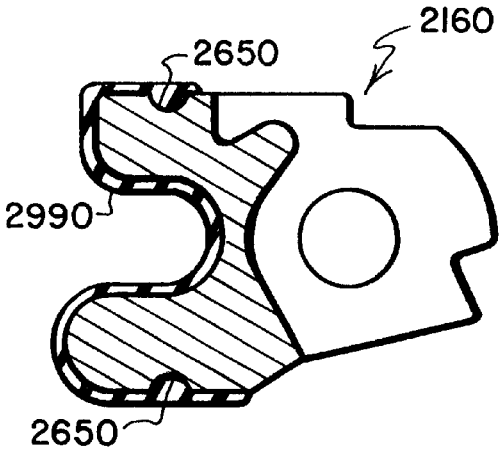

Located on opposite sides of the U-shaped notch 610 are optional recesses 650 that may be provided in order to provide formations that boot-like rubber or elastomeric coatings can grip if it is desired to add a boot-like coating to the rotary jaw 1160 to help silence latch operation. In the FIG. 10 depiction of the rotary jaw 1160, these same recesses are indicated by the numerals 1650. In the FIG. 15 depiction of a rubber or elastomeric coated version of the jaw 1160 (designated by the numeral 2160), these same recesses are indicated by the numerals 2650.

Figure 8:
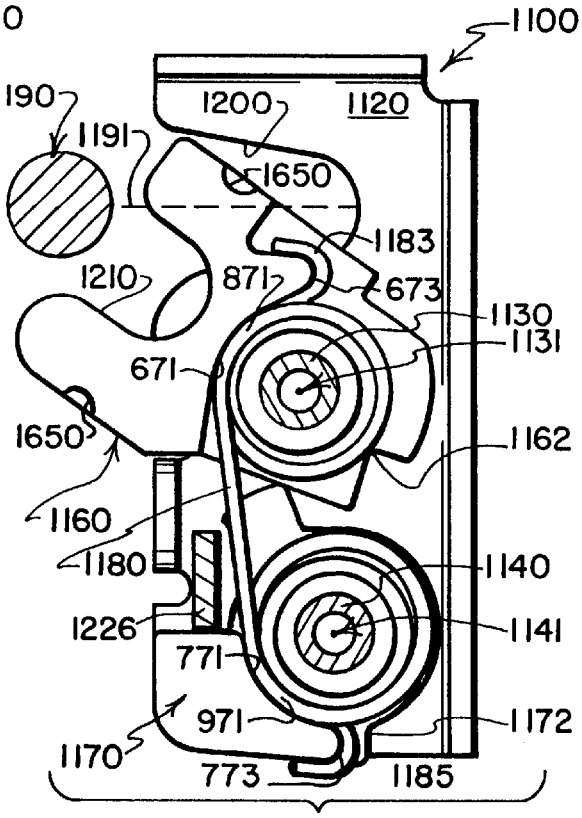
FIG. 8 is a side elevational view similar to FIG. 7 but with the rotary jaw pivoted to its unlatched position, with the rotary pawl in a jaw-releasing position, and with the strike formation moved out of latched engagement along a path of travel indicated by a broken line.

Returning to FIG. 11, located behind the U-shaped notch 610 of the supplementary jaw element 560 is a curved surface 671 having a curvature that substantially matches the curvature of a peripheral portion 871 of the coils 1182 of the spring 1180 (as is best seen in FIGS. 7 and 8), and a convexly curved surface 673 that defines a reversely bent C-shaped formation 683 that is sized and shaped to be closely and snugly received within the C-shaped hook formation 1183 of the spring 1180 (as is best seen in FIG. 10).

Referring to FIG. 12, a rotary pawl 170 is depicted that can be configured exactly like the rotary pawl 170 described previously, or that can be slightly increased in size as may be appropriate to mate with the depicted supplementary pawl element 570. The supplemental pawl element 570 defines a curved surface 771 (very much like the curved surface 671 of the supplemental jaw element 560) having a curvature that substantially matches the curvature of a peripheral portion 971 of the coils 1184 of the spring 1180 (as is best seen in FIGS. 7 and 8), and a convexly curved surface 773 that defines a C-shaped formation 783 that is sized and shaped to be closely and snugly received within the C-shaped hook formation 1185 of the spring 1180 (as is best seen in FIG. 10).

The torsion coil spring 1180 of the latch 1100 is identical to the torsion coil spring 180 of the latch 100 except for the provision of the C-shaped hook formations 1183, 1185 that replace the boxy hook-shaped hook formations 183, 185 of the spring 180. The C-shaped hook formations do not extend transversely out of the secondary plane 1181 (see FIG. 8) of the latch 1100 (as did the boxy hook-shaped formations 183, 185 of the latch 100), but rather remain in the secondary plane 1181 together with other portions of the spring 1180 so as to engage the convexly curved C-shaped formations 683, 783 of the rotary jaw 1160 and the rotary pawl 1170, respectively.

Figure 13:
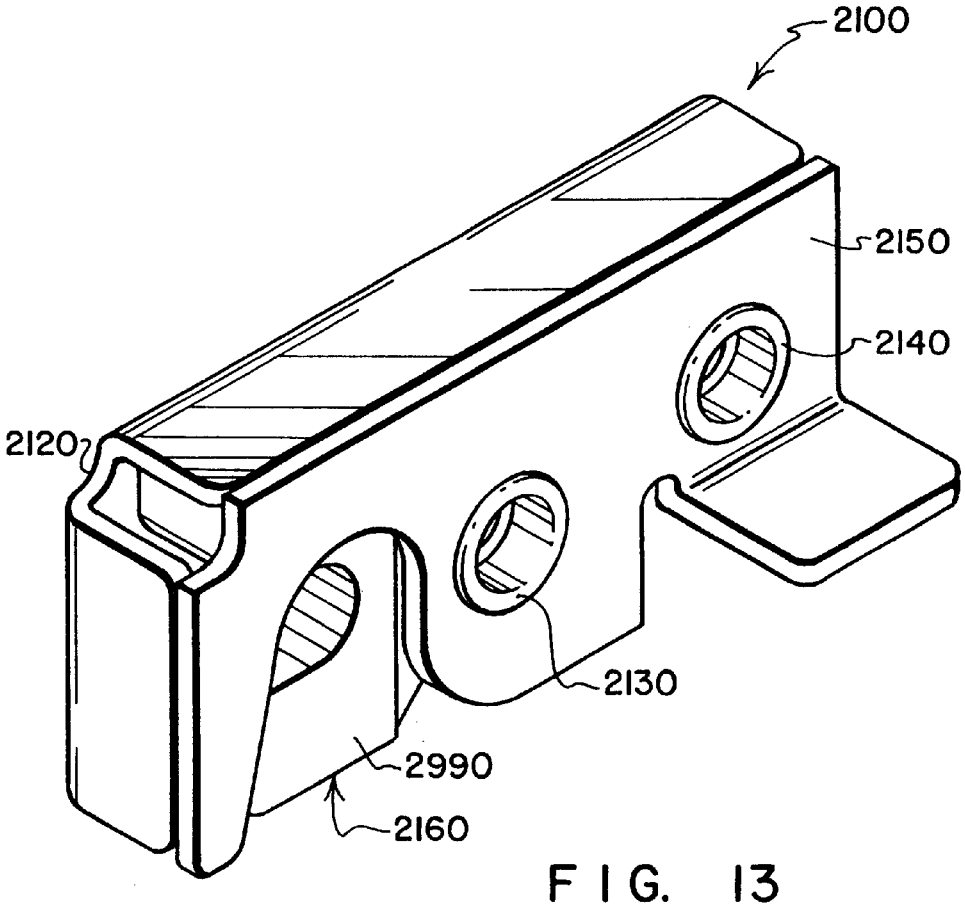
FIG. 13 is a perspective view of another embodiment of a rotary latch that includes features of the present invention.
Figure 14:
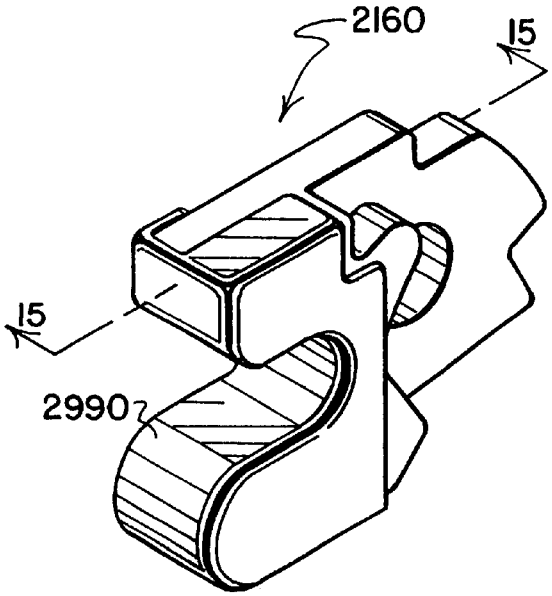
FIG. 14 is a perspective view of the rotary jaw of the latch of FIG. 13; and, FIG. 15 is a sectional view as seen from a plane indicated by a line 15—15 in FIG. 14.

Referring to FIG. 13, a rotary latch 2100 is depicted that is substantially the same as the rotary latch 1100 in that it employs the same housing side plates 2120, 2150 and the same generally cylindrical member 2130, 2140 as are utilized in the latch 1100 where the identical parts are designated by the corresponding numerals 1120, 1150, 1130, 1140. The latches 1100, 2100 differ only in that strike-engageable portions of the rotary jaw 2160 of the latch 2100 are protectively coated with a rubber or elastomeric coating 2990—which is best seen in FIG. 14 wherein the coated rotary jaw 2160 is shown by itself. The coating 2990 covers selected portions of the rotary jaw 2160, especially in regions where the rotary jaw 2160 will engage a strike formation, for the purpose of silencing latch operation. As is shown in the cross-sectional view of FIG. 15, the protective coating 2990 has portions 2991, 2992 that depend into the recesses 2650 to provide a connection that helps to retain the coating 2990 in place on the rotary jaw 2160.

While the improved rotary latches 1100, 2100 employ only one coiled torsion spring (of the type shown in FIGS. 6–10 and designated by the numeral 1180), it will be understood that, instead of utilizing a single spring having two sets of torsion coils 1182, 1184, separate springs that each has only one set of torsion coils can be utilized equally effectively. Likewise, it will be understood that other modifications of the general type disclosed in the referenced Rotary Latch Patents also can be incorporated, which is to say that features of the present invention can be used with a wide variety of rotary latches and locks that employ rotary jaws and rotary pawls.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A rotary latch, comprising:

a) a rotary jaw and a rotary pawl that are mounted for limited pivotal movement about separate substantially parallel-extending axes, wherein the rotary jaw is pivotal between a latched position and an unlatched position, and wherein the rotary pawl is pivotal between a jaw-retaining position wherein a jaw-engageable portion of the rotary pawl is engageable with a pawl-engageable portion of the rotary jaw to retain the rotary jaw in the latched position, and a jaw-releasing position wherein the jaw-engageable portion of the rotary pawl disengages the pawl-engageable portion of the rotary jaw and thereby permits the rotary jaw to pivot from the latched position to the unlatched position, wherein the rotary jaw also includes a strike-engageable portion adapted to latchingly engage a strike formation when the rotary jaw is in the latched position, and to release the strike formation for movement toward and away from the rotary jaw when the rotary jaw is in the unlatched position, wherein the jaw-engageable portion, the pawl-engageable portion and the strike-engageable portion all extend within a primary plane that is substantially perpendicular to the parallel-extending axes;

b) biasing means for biasing the rotary jaw away from the latched position toward the unlatched position, and for biasing the rotary pawl away from the jaw-releasing position toward the jaw-retaining position, wherein the biasing means includes at least one torsion spring having at least one torsion spring coil that surrounds at least one of the parallel-extending axes and at least one reach of spring material that extends from a peripheral portion of the spring coil to define a C-shaped hook formation, wherein the torsion spring coil, the reach of spring material and the C-shaped hook formation all extend within a secondary plane located beside and substantially paralleling the primary plane; and, c) means for engaging the peripheral portion of the torsion spring coil and the C-shaped hook formation to establish a connection between the torsion spring and a selected one of the rotary jaw and the rotary pawl, including a first connection portion of the selected one of the rotary jaw and the rotary pawl that extends transversely from the primary plane into the secondary plane to define within the secondary plane a first surface that is positioned to extend along a length of the peripheral portion adjacent the reach of spring material that defines the C-shaped hook formation, and a second surface that joins smoothly with the first surface to define a convexly curved C-shaped formation that substantially matches the shape of and is adapted to be received within the C-shaped hook formation defined by the reach of spring material that extends from the peripheral portion of the torsion spring coil, wherein the connection that is established between the torsion spring and the selected one of the rotary jaw and the rotary pawl is located along portions of the first and second surfaces that reside within the secondary plane.

2. The rotary latch of claim 1 wherein the first surface is a curved surface having substantially the same curvature as the peripheral portion of the torsion coil spring, the second curved surface joins smoothly with the first curved surface, and the first curved surface is positioned to engage a length of the peripheral portion adjacent the reach of spring material that defines the C-shaped hook formation.

3. The rotary latch of claim 2 wherein the selected one of the rotary jaw and the rotary pawl is the rotary jaw.

4. The rotary latch of claim 2 wherein the selected one of the rotary jaw and the rotary pawl is the rotary pawl.

5. The rotary latch of claim 2 wherein the selected one of the rotary jaw and the rotary pawl is the rotary jaw, wherein the biasing means includes another torsion spring coil located beside the rotary pawl that has a another peripheral portion and another reach of material that defines another reverse-bend C-shaped hook formation, and wherein the rotary pawl is provided with a second connection portion configured substantially the same as the first connection portion that extends into the secondary plane to establish engagement with and connection to the another peripheral portion and the another C-shaped hook formation.

6. The rotary latch of claim 1 additionally including a pair of housing side plates that sandwich the rotary jaw, the rotary pawl and the biasing means therebetween, wherein the housing side plates extend in spaced planes that substantially parallel the primary and secondary planes, and at least one of the housing side plates defines a first generally U-shaped notch that cooperates with the strike-engageable portion of the rotary jaw to latchingly retain the strike formation therein when the rotary jaw is in the latched position.

7. The rotary latch of claim 6 wherein the strike-engageable portion of the rotary jaw defines a second generally U-shaped notch configured to cooperate with the first generally U-shaped notch to receive and latchingly retain the strike formation within the first and second generally U-shaped notches when the rotary jaw is in the latched position, and to release the strike formation for movement into and out of the first generally U-shaped notch when the rotary jaw is in the unlatched position.

8. The rotary latch of claim 7 wherein the housing side plates are held in fixed spaced relationship by a pair of generally cylindrical spacers that extend along the parallel-extending axes, with each of spacers having one end region securely connected to one of the housing side plates and another end region securely connected to the other of the housing side plates.

9. The rotary latch of claim 8 wherein the first U-shaped notch is defined by said one of the housing side plates, and a third U-shaped notch is defined by said other of the housing side plates, and the first, second and third U-shaped notches cooperate to receive and to latchingly retain the strike formation therein when the rotary jaw is in the latched position.

10. The rotary latch of claim 1 additionally including a housing defined by a pair of side plates held in spaced parallel-extending relationship by a first generally cylindrical member and a second generally cylindrical member that each extend along a separate one of said parallel-extending axes, wherein the rotary jaw has a first mounting portion that defines a hole through which the first generally cylindrical member extends to mount the rotary jaw on the first generally cylindrical member, wherein the rotary pawl has a second mounting portion that defines a hole through which the second generally cylindrical member extends to mount the rotary pawl on the second generally cylindrical member, and wherein the first and second mounting portions extend within the primary plane.

11. The rotary latch of claim 10 wherein the strike engageable portion has a strike-engageable part that extends within the secondary plane.

12. The rotary latch of claim 11 wherein the strike-engageable part which extends within the secondary plane is formed separately from such other portions of the rotary jaw as extend within the primary plane, and the strike-engageable part is rigidly connected to such other portions.

13. The rotary latch of claim 11 wherein the strike-engageable part which extends within the secondary plane is formed integrally with such other portions of the rotary jaw as extend within the primary plane.

14. The rotary latch of claim 11 wherein the strike-engageable part defines opposed recesses that are engaged by an elastomeric coating applied to a majority of the strike-engageable portion to silence operation of the latch.

15. The rotary latch of claim 1 wherein the strike-engageable portion has an elastomeric coating applied thereto to silence operation of the latch, and the strike-engageable portion defines at least one formation configured to engage the coating to aid in retaining the coating in place on the strike-engageable portion.

16. A rotary latch, comprising:

a) a housing including at least one side plate that defines a first U-shaped notch adapted to be positioned along a path of travel followed by a strike formation when the housing and the strike formation are moved relative to each other to bring the strike formation into and out of the first U-shaped notch, including a first generally cylindrical member connected near one end thereof to the side plate and extending away from the side plate along a first axis, and including a second generally cylindrical member connected near one end thereof to the side plate and extending away from the side plate along a second axis that parallels the first axis at a distance spaced therefrom;

b) a rotary jaw having a first mounting portion that mounts the rotary jaw on the first generally cylindrical member for pivotal movement about the first axis between a latched position and an unlatched position, wherein the rotary jaw has a strike-engageable formation that defines a second U-shaped notch adapted to cooperate with the first U-shaped notch to receive and latchingly retain the strike formation in the first and second U-shaped notches when the rotary jaw is in the latched position, and to permit the strike formation to move into and out of the first U-shaped notch when the rotary jaw is in the unlatched position;

c) a rotary pawl having a second mounting portion that mounts the rotary pawl on the second generally cylindrical member for pivotal movement about the second axis between a jaw-retaining position and a jaw-releasing position, wherein the rotary pawl has a jaw-engageable portion adapted to engage a pawl-engageable portion of the rotary jaw when the rotary pawl is in the jaw-retaining position to retain the rotary jaw in the latched position, and to disengage the jaw-engageable portion when in the jaw-releasing position to permit the rotary jaw to pivot between the latched and unlatched positions;

d) wherein the the rotary jaw and the rotary pawl are mounted on the housing such that the first and second mounting portions, the strike-engageable portion, the jaw-engageable portion and the pawl-engageable portion all extend substantially within a primary plane that is substantially perpendicular to the parallel-extending axes;

e) biasing means for biasing the rotary jaw away from the latched position toward the unlatched position, and for biasing the rotary pawl away from the jaw-releasing position toward the jaw-retaining position, wherein the biasing means includes at least one torsion spring having at least one torsion spring coil that surrounds at least one of the first and second axes and at least one reach of spring material that extends from a peripheral portion of the spring coil to define a C-shaped hook formation, wherein the torsion spring coil, the reach of spring material and the C-shaped hook formation all extend within a secondary plane located beside and substantially paralleling the primary plane; and, f) means for engaging the peripheral portion of the torsion spring coil and the C-shaped hook formation to establish a connection between the torsion spring and a selected one of the rotary jaw and the rotary pawl, including a first connection portion of the selected one of the rotary jaw and the rotary pawl that extends transversely from the primary plane into the secondary plane to define within the secondary plane a first surface that is positioned to extend along the peripheral portion, and a second surface that joins smoothly with the first surface to define a convexly curved C-shaped formation that is adapted to be received snugly within the C-shaped hook formation, wherein the connection that is established between the torsion spring and the selected one of the rotary jaw and the rotary pawl is located along portions of the first and second surfaces that reside within the secondary plane.

17. The rotary latch of claim 16 wherein the first surface is a curved surface having substantially the same curvature as the peripheral portion of the torsion coil spring, the second curved surface joins smoothly with the first curved surface, and the first curved surface is positioned to engage a length of the peripheral portion adjacent the reach of spring material that defines the C-shaped hook formation.

18. The rotary latch of claim 17 wherein the selected one of the rotary jaw and the rotary pawl is the rotary jaw.

19. The rotary latch of claim 17 wherein the selected one of the rotary jaw and the rotary pawl is the rotary pawl.

20. The rotary latch of claim 17 wherein the selected one of the rotary jaw and the rotary pawl is the rotary jaw, wherein the biasing means includes another torsion spring coil located beside the rotary pawl that has a another peripheral portion and another reach of material that defines another reverse-bend C-shaped hook formation, and wherein the rotary pawl is provided with a second connection portion configured substantially the same as to the first connection portion that extends into the secondary plane to establish engagement with and connection to the another peripheral portion and the another C-shaped hook formation.

21. The rotary latch of claim 20 wherein the strike-engageable portion has an elastomeric coating applied thereto to silence operation of the latch, and the strike-engageable portion defines at least one formation configured to engage the coating to aid in retaining the coating in place on the strike-engageable portion.

22. The rotary latch of claim 16 wherein the strike engageable portion has a strike-engageable part that extends within the secondary plane.

23. The rotary latch of claim 22 wherein the strike-engageable part which extends within the secondary plane is formed separately from such other portions of the rotary jaw as extend within the primary plane, and the strike-engageable part is rigidly connected to such other portions.

24. The rotary latch of claim 22 wherein the strike-engageable part which extends within the secondary plane is formed integrally with such other portions of the rotary jaw as extend within the primary plane.

25. The rotary latch of claim 22 wherein the strike-engageable part defines opposed recesses that are engaged by an elastomeric coating applied to a majority of the strike-engageable portion to silence operation of the latch.

26. The rotary latch of claim 22 wherein the rotary jaw has a first U-shaped surface portion extending within the primary plane that defines the second U-shaped notch, and wherein the strike engageable part extending within the secondary plane has a second U-shaped surface portion that joins smoothly with the first U-shaped surface portion so as to increase the surface area of the second U-shaped notch that is engageable with the strike formation when the rotary jaw is in the latched position.

27. A rotary latch, comprising:

a) a housing including a pair of side plates, one of which defines a first U-shaped notch adapted to be positioned along a path of travel followed by a strike formation when the housing and the strike formation are moved relative to each other to bring the strike formation into and out of the first U-shaped notch, including a first generally cylindrical member extending along a first axis between the side plates and rigidly connected near opposite end regions thereof to the side plates, and including a second generally cylindrical member extending along a second axis between the side plates and rigidly connected near opposite end regions thereof to the side plates, wherein the first and second axes are spaced one from the other and extend substantially parallel to each other;

b) a rotary jaw having a first mounting portion that mounts the rotary jaw on the first generally cylindrical member for pivotal movement about the first axis between a latched position and an unlatched position, wherein the rotary jaw has a strike-engageable formation that defines a second U-shaped notch adapted to cooperate with the first U-shaped notch to receive and latchingly retain the strike formation in the first and second U-shaped notches when the rotary jaw is in the latched position, and to permit the strike formation to move into and out of the first U-shaped notch when the rotary jaw is in the unlatched position;

c) a rotary pawl having a second mounting portion that mounts the rotary pawl on the second generally cylindrical member for pivotal movement about the second axis between a jaw-retaining position and a jaw releasing position, wherein the rotary pawl has a jaw-engageable portion adapted to engage a pawl-engageable portion of the rotary jaw when the rotary pawl is in the jaw-retaining position to retain the rotary jaw in the latched position, and to disengage the jaw-engageable portion when in the jaw-releasing position to permit the rotary jaw to pivot between the latched and unlatched positions;

d) wherein the the rotary jaw and the rotary pawl are mounted on the housing such that the first and second mounting portions, the strike-engageable portion, the jaw-engageable portion and the pawl-engageable portion all extend substantially within a primary plane that is substantially perpendicular to the parallel-extending axes;

e) biasing means for biasing the rotary jaw away from the latched position toward the unlatched position, and for biasing the rotary pawl away from the jaw-releasing position toward the jaw-retaining position, wherein the biasing means includes at least one torsion spring having at least one torsion spring coil that surrounds a selected one of the first and second axes and at least one reach of spring material that extends from a peripheral portion of the spring coil in a direction away from the selected one of the first and second axes to define a reverse-bend C-shaped hook formation, wherein the torsion spring coil, the reach of spring material and the reverse-bend C-shaped hook formation all extend within a secondary plane located beside and substantially paralleling the primary plane; and, f) means for engaging the peripheral portion of the torsion spring coil and the reverse-bend C-shaped hook formation to establish a connection between the torsion spring and a selected one of the rotary jaw and the rotary pawl, including a first connection portion of the selected one of the rotary jaw and the rotary pawl that extends transversely from the primary plane into the secondary plane to define within the secondary plane a first curved surface that has substantially the same curvature as the peripheral portion of the spring coil so as to extend along the peripheral portion, and a second curved surface that joins smoothly with the first surface to define a convexly curved, reversely bent, C-shaped formation that is adapted to be closely received within the reverse-bend C-shaped hook formation, wherein the connection that is established between the torsion spring and the selected one of the rotary jaw and the rotary pawl is located along portions of the first and second surfaces that reside within the secondary plane.

28. The rotary latch of claim 27 wherein the selected one of the rotary jaw and the rotary pawl is the rotary jaw.

29. The rotary latch of claim 27 wherein the selected one of the rotary jaw and the rotary pawl is the rotary pawl.

30. The rotary latch of claim 27 wherein the selected one of the rotary jaw and the rotary pawl is the rotary jaw, wherein the biasing means includes another torsion spring coil located beside the rotary pawl that has a another peripheral portion and another reach of material that defines another reverse-bend C-shaped hook formation, and wherein the rotary pawl is provided with a second connection portion configured substantially the same as to the first connection portion that extends into the secondary plane to establish engagement with and connection to the another peripheral portion and the another C-shaped hook formation.

31. The rotary latch of claim 27 wherein the strike-engageable portion has an elastomeric coating applied thereto to silence operation of the latch, and the strike-engageable portion defines at least one formation configured to engage the coating to aid in retaining the coating in place on the strike-engageable portion.

32. The rotary latch of claim 27 wherein the strike engageable portion has a strike-engageble part that extends within the secondary plane.

33. The rotary latch of claim 32 wherein the strike-engageable part which extends within the secondary plane is formed separately from such other portions of the rotary jaw as extend within the primary plane, and the strike-engageable part is rigidly connected to such other portions.

34. The rotary latch of claim 32 wherein the strike-engageable part which extends within the secondary plane is formed integrally with such other portions of the rotary jaw as extend within the primary plane.

35. The rotary latch of claim 32 wherein the strike-engageable part defines opposed recesses that are engaged by an elastomeric coating applied to a majority of the strike-engageable portion to silence operation of the latch.

36. The rotary latch of claim 27 wherein the rotary jaw has a first U-shaped surface portion extending within the primary plane that defines the second U-shaped notch, and wherein the strike engageable part extending within the secondary plane has a second U-shaped surface portion that joins smoothly with the first U-shaped surface portion so as to increase the surface area of the second U-shaped notch that is engageable with the strike formation when the rotary jaw is in the latched position.

37. A rotary latch, comprising:

a) a housing that defines a first U-shaped notch located along a path of travel that is followed by a strike formation when the strike formation is brought into the first U-shaped notch for being latchingly retained therein, wherein the first U-shaped notch is defined, at least in part, by housing portions that provide a pair of spaced, opposed surfaces located on opposite sides of the path of travel and a curved surface that interconnects the opposed surfaces and that cooperates with the opposed surfaces to give the first U-shaped notch a U-shaped appearance, and wherein the housing portions that provide the pair of opposed surfaces and the curved surface extend substantially within a common plane of the housing;

b) a pair of rotary latch elements supported by the housing for limited pivotal movement about separate, spaced-apart, substantially parallel extending axes that extend substantially perpendicular to the common plane of the housing, including:

i) a rotary jaw having a strike-engageable portion that defines a second U-shaped notch configured to cooperate with the first U-shaped notch to latchingly retain the strike formation in the first and second U-shaped notches when the rotary jaw is pivoted relative to the housing to a latched position, and to permit the strike formation to be moved into and out of the first U-shaped notch when the rotary jaw is pivoted relative to the housing to an unlatched position; and, having a pawl-engageable portion that can be engaged when the rotary jaw is in the latched position to retain the rotary jaw in the latched position;

ii) a rotary pawl having a jaw-engageable portion adapted to engage the pawl-engageable portion to retain the rotary jaw in the latched position when the rotary pawl is pivoted relative to the housing to a jaw-retaining position, and adapted to disengage the jaw-engageable portion to permit the rotary jaw to pivot out of the latched position when the rotary pawl is pivoted relative to the housing to a jaw-releasing position;

c) biasing means for biasing the rotary jaw away from the latched position toward the unlatched position, and for biasing the rotary pawl away from the jaw-releasing position toward the jaw-retaining position;

d) wherein the strike-engageable portion, the jaw-engageable portion and the pawl-engageable portion extend principally within a primary plane that is spaced a short distance from and substantially parallels the common plane of the housing;

e) wherein at least a selected one of the rotary jaw and the rotary pawl has a secondary portion located in a secondary plane located adjacent to and substantially paralleling the first common plane of the rotary latch;

f) wherein the biasing means includes portions of a coiled torsion spring that extend within the secondary plane along one side of the selected one of the rotary jaw and the rotary pawl, with said spring portions including a reach of spring material that defines a C-shaped hook formation; and, g) wherein the secondary portion of the selected one of the rotary jaw and the rotary pawl defines a convexly curved formation configured to be matingly received within and closely engaged by the C-shaped hook formation to thereby establish within the second common plane a driving connection between the biasing means and the selected one of the rotary jaw and the rotary pawl.

38. The rotary latch of claim 37 wherein the selected one of the rotary jaw and the rotary pawl is the rotary jaw, and the driving connection serves to bias the rotary jaw away from the latched position toward the unlatched position.

39. The rotary latch of claim 37 wherein the selected one of the rotary jaw and the rotary pawl is the rotary pawl, and the driving connection serves to bias the rotary pawl away from the jaw-releasing position toward the jaw-retaining position.

40. The rotary latch of claim 37 wherein each of the rotary jaw and the rotary pawl is provided with one of said secondary portions that extends in said secondary plane, the biasing means includes coiled torsion spring portions located alongside each of the rotary jaw and the rotary pawl with spring portions defining reaches of spring material that have C-shaped hook formations defined by gently rounded bends, and driving connections are established by the C-shaped hook formations engaging said secondary portions for biasing the rotary jaw away from the latched position toward the unlatched position, and for biasing the rotary pawl away from the jaw-releasing position toward the jaw-retaining position.

* * * * *